US005178516A

United States Patent [19]

Nakagawa et al.

[11] Patent Number: 5,178,516

[45] Date of Patent: Jan. 12, 1993

[54] CENTRIFUGAL COMPRESSOR

[75] Inventors: Koji Nakagawa, Kashiwa; Takeo Takagi, Tsukuba; Junichi Kaneko, Ibaraki; Yoshiaki Abe, Ibaraki; Haruki Sakai, Ibaraki, all of Japan

[73] Assignee: Hitachi, Ltd., Tokyo, Japan

[21] Appl. No.: 591,651

[22] Filed: Oct. 2, 1990

[51] Int. Cl.[5] ..... F04D 29/30

[52] U.S. Cl. ..... 415/208.30; 415/211.2

[58] Field of Search ..... 415/208.1, 211.2, 208.2, 415/208.3, 914

[56] References Cited

U.S. PATENT DOCUMENTS

| | | | |
|---|---|---|---|
| 2,967,013 | 1/1961 | Dallenbach | 415/208.3 |
| 3,356,289 | 12/1967 | Plotkowiak | 415/208.3 |
| 3,781,128 | 12/1973 | Bandukwalla | 415/914 |
| 3,918,829 | 11/1975 | Korzec | 415/208.2 |
| 4,349,314 | 9/1982 | Erwin | 415/208.3 |
| 4,395,197 | 7/1983 | Yoshinaga | 415/914 |
| 4,877,370 | 10/1989 | Nakagawa | 415/118 |
| 4,902,200 | 2/1990 | Bandukwalla | 415/914 |

FOREIGN PATENT DOCUMENTS

| | | | |
|---|---|---|---|
| 135697 | 7/1985 | Japan | 415/208.3 |

*Primary Examiner*—Edward K. Look

*Assistant Examiner*—James A. Larson

*Attorney, Agent, or Firm*—Antonelli, Terry, Stout & Kraus

[57] ABSTRACT

A centrifugal compressor has diffusers which convert a high velocity, low pressure stream of fluid which flows out of an impeller to a high-velocity high-pressure flow due to the action of a purality of stator blades disposed near the outer periphery of the impeller. In this compressor, the portion of the stator blade or of an auxiliary blade which is provided in the diffuser located on the side of a front shroud is disposed closer to the impeller than the portion thereof located on the side of a main shroud, and the leading edge of the stator blade is thus inclined from the portion thereof located on the side of the main shroud to the portion thereof located on the side of the front shroud. The configuration of the front edge of a stator blade or of an auxiliary blade which is provided in the diffuser is so improved as to restrict back flow which occurs on the side of the front shroud when the flow rate is small and to lower the minimum flow rate. Furthermore, an auxiliary blade and an intermediate blade are disposed between the adjacent stator blades, and the leading edge of the auxiliary blade is so improved as to enlarge the operation range of the diffuser and to improve volume control greatly.

6 Claims, 13 Drawing Sheets

$r_i$ : THE RADIUS OF THE IMPELLER $r_s$ : THE RADIUS OF THE PORTION OF THE LEADING EDGE LOCATED ON THE SIDE OF THE FRONT SHROUD $r_h$ : THE RADIUS OF THE PORTION OF THE LEADING EDGE LOCATED ON THE SIDE OF THE MAIN SHROUD b : THE HEIGHT OF THE STATOR BLADE $b_i$ : THE AVERAGE HEIGHT OF THE PORTION OF THE LEADING EDGE LOCATED ON THE SIDE OF THE FRONT SHROUD

CENTRIFUGAL COMPRESSOR

BACKGROUND OF THE INVENTION

1. Field of the Invention

The present invention relates to a centrifugal compressor, and more particularly, to a centrifugal compressor provided with diffusers which is required for an enlarged operation range and a high efficiency.

2. Description of the Related Art

In the centrifugal compressors, the flow of a gas or vapor is generally distorted in a widthwise direction at the exit of a centrifugal impeller. This tendency is evident in a compressor whose ratio of compression per stage is larger than 2. The gas flow is distorted such that the direction thereof is close to the tangential direction of the impeller on the side of a front shroud and deviates from the tangential direction on the side of a main shroud as compared with that of the gas flow on the side of the front shroud.

In such a compressor, an increase in the flow rate results in choke in the minimum cross-sectional area of a diffuser formed by the stator blades and the side walls and therefore thus decreases the performance of the compressor suddenly. Furthermore, under the operation conditions in which the rotational speed is relatively high and in which the flow rate is low, separation occurs on a suction surface of a stator blade, thereby generating surging in which a sufficient pressure increase cannot be obtained. These problems are solved by a diffuser with an auxiliary blade provided between the adjacent stator blades.

In the case where the auxiliary blade is provided in the diffuser, an auxiliary blade which is as thin as possible is desired to prevent an decrease in the minimum cross-sectional area of the flow passage. However, a minimum thickness is necessary in terms of the strength. Hence, the number of stator blades is determined such that it assures a sufficient cross-sectional area of the flow passage. However, this increases the gap between the stator blades near the outer periphery of the stator blades. As a result, separation occurs in a large scale along he suction surface of the stator blade near the trailing edge thereof, and the cross-sectional area of the gas flow, hence, the cross-sectional area of the diffuser substantially thereby decreases while diffusion of the kinetic energy occurs in the separation.

The operation range of the centrifugal compressor of the above-described type is often limited by the diffuser. That is, stalling of the gas flow in which the back flow of the gas generated in the diffuser reaches the impeller determines the minimum flow rate, and choke in the diffuser determines the maximum flow rate. Hence, it is said that the operation range of the compressor can be enlarged by enlarging the operation range of the diffuser, and several techniques thereof have been proposed. In one of such techniques which have been widely used, stator blades are supported in such a manner as to be rotatable about a shaft provided parallel to the shaft of the impeller, and the direction of the stator blades is varied in accordance with the direction of a gas which flows out of the impeller. In another technique, the distal end of the stator blade is extended to form a boundary layer fence (disclosed in U.S. Pat. No. 3,781,128). In another technique, the angle of inlet of the stator blade is varied in the direction of height thereof (disclosed in U.S. Pat. No. 3,904,312, Japanese Utility Model Unexamined Publication No. 53-162405).

However, the conventional compressor of the above-described type in which the stator blades are made movable have a complicated configuration. In the compressor in which the boundary layer fences are provided, the effect of the boundary layer fences cannot be expected sufficiently in the case of the high-speed centrifugal compressor in which distortion of the flow of fluid at the exit of the impeller is large. In the case of the compressor in which the angle of inlet of the stator blade can be varied in the direction of the height thereof, sufficient enlargement of the operation range cannot be obtained. Furthermore, in the compressor in which the leading edge of the stator blade is disposed close to the impeller in order to enlarge the operation range, the stator blade or the impeller may be broken after the operation over a long period of time due to the strong exciting force caused by the aerodynamical interference between the impeller and the stator blade.

OBJECT OF THE INVENTION

An object of the present invention is to provide a centrifugal compressor in which the configuration of the leading edge of a stator blade or of an auxiliary blade is so improved as to restrict back flow which occurs on the side of a front shroud when the flow rate is small and thereby lower the minimum flow rate.

Another object of the present invention is to provide a centrifugal compressor in which an auxilairy blade and an intermediate blade are disposed between adjacent stator blades while the leading edge of the auxiliary blade is so improved as to enlarge the operation range of the diffuser and greatly improve volume control.

SUMMARY OF THE INVENTION

The present invention provides a centrifugal compressor with diffusers provided therein so as to convert a high velocity, low pressure stream of fluid which flows out of an impeller to a low-velocity high-pressure flow due to the action of a plurality of stator blades disposed near the outer periphery of the impeller. In this compressor, the portion of the stator blade located on the side of the front shroud is extended toward the impeller, and the leading edge of the stator blade is thus inclined from the portion thereof located on the side of a main shroud to the portion thereof located on the side of the front shroud.

In this invention, since the portion of the leading edge of the stator blade located on the side of the front shroud is located close to the impeller, the direction of flow of the fluid which is close to the tangential direction can be forcibly led toward the stator blade, thereby reducing the possiblity of occurrence of back flow and lowering the flow rate at which occurrence of surging is eliminated.

Furthermore, since the portion of the leading edge of the stator blade located on the side of the main shroud is disposed farther from the impeller than the portion thereof located on the side of the front shroud, the minimum cross-sectional area of the flow passage can be readily and sufficiently increased. This prevents lowering of the maximum flow rate of the compressor due to the choke in the diffuser.

Furthermore, since part of the leading edge of the stator blade is present near the impeller, the exciting force caused by the aerodynamical interference can be greatly reduced.

The present invention further provides a compressor in which an auxiliary blade, having a chord length shorter than that of the stator blade and a height equal to or smaller than that of the stator blade, is provided near the inner periphery of the stator blade between the adjacent stator blades. Only one of the surfaces of the auxiliary blade is disposed in opposed relation to the stator blade. The portion of the leading edge of the auxilairy blade located on the side of the front shroud is disposed closer to the impeller than the portion thereof lcoated on the side of the main shroud.

In this invention, since the auxiliary blade is provided between the adjacent stator blades near the inner periphery thereof in such a manner that the only one surface of the auxiliary blade is opposed to the stator blade, the auxiliary blade does not enter the minimum cross-sectional area of the flow passage formed by the stator blades and the side walls. In consequence, lowering of the minimum flow rate can be made possible by disposing the leading edges of the auxiliary blades close to the impeller while the maximum flow rate can be unchanged. In that case, since only the part of the leading edge of the auxiliary blade is present close to the impeller, exciting force caused by the aerodynamical interference can be greatly reduced and the relative strength of the auxiliary blades and of the impeller can thus be increased. In the case where the auxiliary blade has a partitioning plate on the downstream side thereof which has a smaller height than the auxiliary blade and which extends along the stator blade, the rigidity of the auxiliary blade can be further increased.

The present invention further provides a compressor in which an intermediate blade, having a chord length smaller than that of the stator blade and a height equal to or smaller than that of the stator blade, is provided between the stator blades near the outer periphery thereof.

In this invention, since the space between the stator blades near the outer peripheral edges thereof substantially has an adequate value, a lowering of performance of the compressor can be prevented.

The present invention further provides a compressor in which the auxiliary blade and the intermediate blade are connected by a partitioning plate which has a height smaller than that of the other blades and which extends along the stator blades.

In this invention, since the auxiliary blade, the partitioning plate and the intermediate blade are formed as one unit, rigidity thereof can further increase.

DESCRIPTION OF THE PREFERRED EMBODIMENTS

Figure 1:
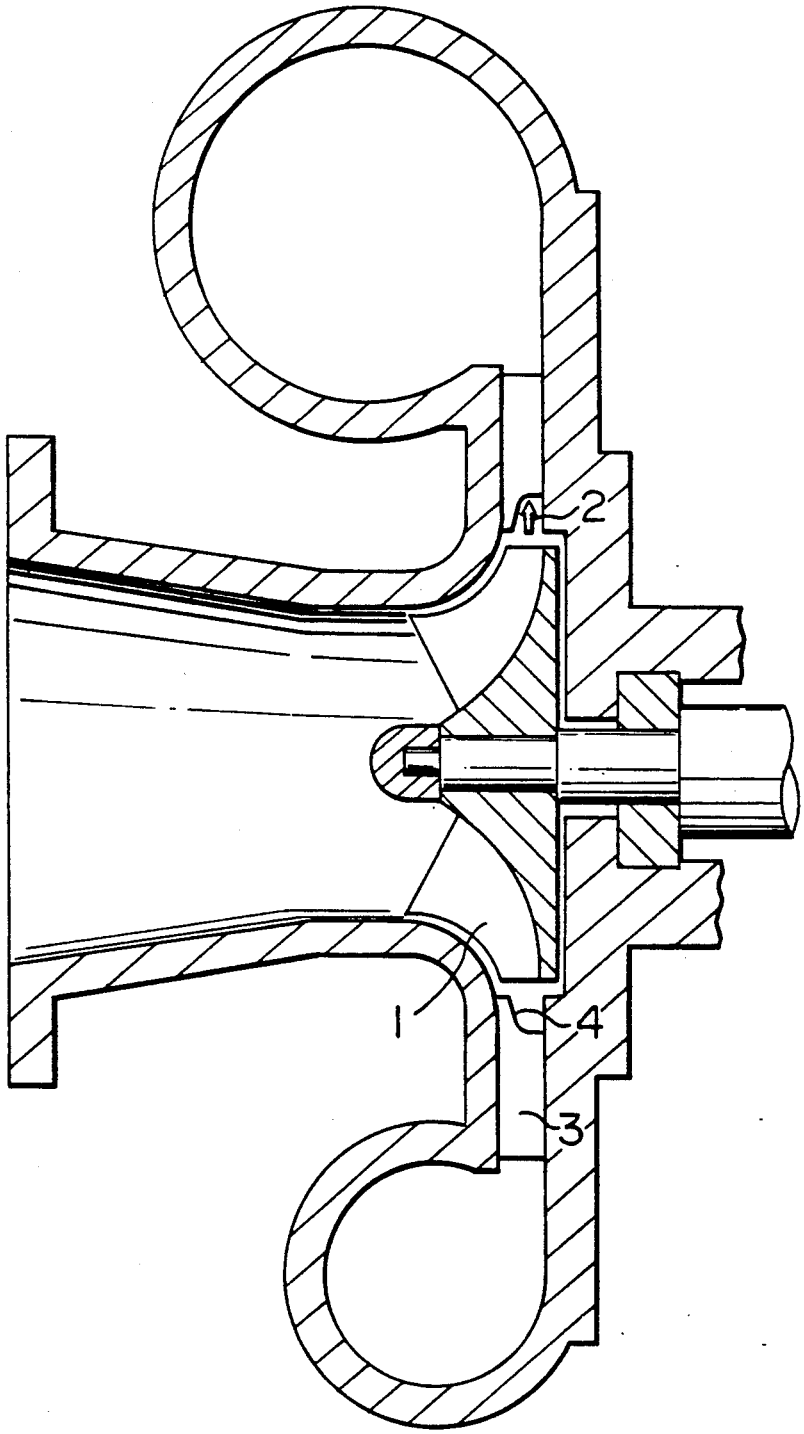
FIG. 1 is a vertical cross-sectional view of an embodiment of a high-speed centrifugal compressor according to the present invention.
Figure 2:
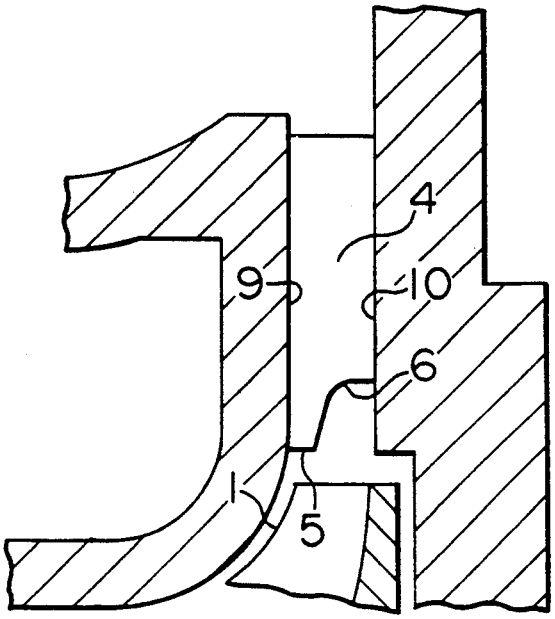
FIG. 2 is a vertical cross-sectional view of the essential parts of the compressor of FIG. 1.
Figure 3:
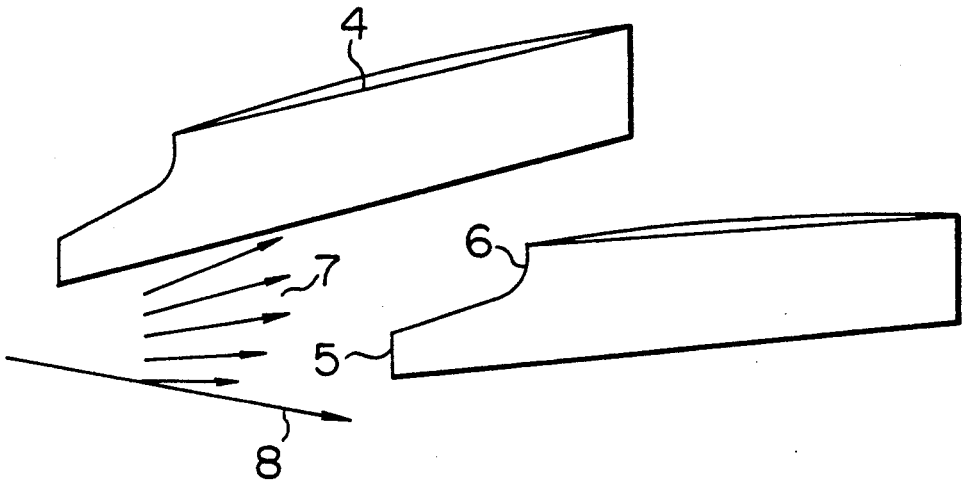
FIG. 3 shows the essential parts of FIG. 2 three-dimensionally.

A first embodiment of the present invention will be described below with reference to FIGS. 1 to 3. FIG. 1 is a cross-sectional view of an impeller of a centrifugal compressor according to the present invention, and FIG. 2 is an enlarged view of a diffuser of the compressor of FIG. 1. A high-speed centrifugal compressor is designed to generate flow of an air in a direction indicated by an arrow 2 by rotating an impeller 1 and thereby to produce a high ratio of compression per stage. In such a compressor, since the stream of air 2 which comes out of the impeller 1 has large kinetic energy, a high velocity, low-pressure stream of fluid discharged from the impeller 1 is passed through diffusers 3 with stator blades disposed around the impeller 1 and thereby converted into a high-velocity, high-pressure flow. The diffuser 3 is provided with a stator blade 4 at the outer periphery of the impeller.

The plurality of stator blades 4 are disposed in a radial fashion around the impeller 1 to form a diffuser 3 between the adjacent stator blades 4. A leading edge portion 5 of the stator blade 4 which is located on the side of a front shroud is disposed near the outlet of the impeller while a leading edge portion 6 of the stator blade 4 located on the side of a main shroud is disposed far from the impeller 1. FIG. 3 shows stator blades together with velocity vectors 7. The direction of the velocity vectors located on the side of the front shroud is close to the tangential direction 8 of the impeller. However, they are led toward the stator blade 4 due to the presence of the leading edge portion 5 of the stator blade which extends close to the impeller. In consequence, occurrence of back flow of the air which flows out of the impeller is restricted and the operation range of the compressor is thereby enlarged on the small flow rate side thereof.

Although the minimum cross-sectional area of the flow passage defined by the stator blade 4, a side wall 9 located on the side of the front shroud, and a side wall 10 located on the side of the main shroud is determined by the configuration of the stator blade 4 or the like, when the leading edge of the stator blade 4 is disposed far from the impeller, the circumference of a circle which passes through the leading edges of all the stator blades 4 is long, and the minimum cross-sectional area can be thus be made large. Since the leading edge portion 6 of the stator blade 4 located near the main shroud is far from the impeller, the minimum cross-sectional area can be greatly enlarged and the operation range can thus be enlarged on the large flow rate side as compared with the case in which the leading edge portion of the stator blade 4 is entirely located near the impeller.

Figure 4:
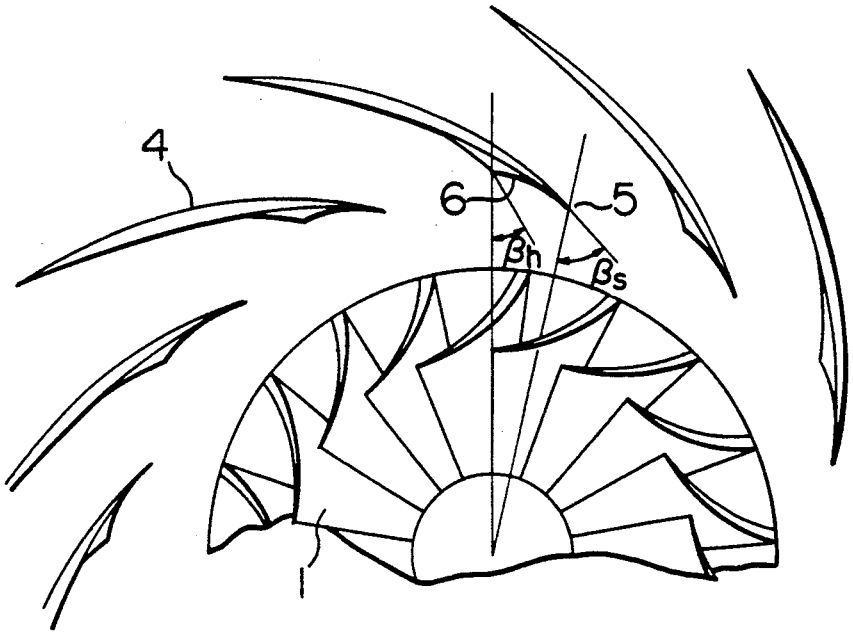
FIG. 4 is a horizontal cross-sectional view of another embodiment of the centrifugal compressor according to the present invention.
Figure 5:
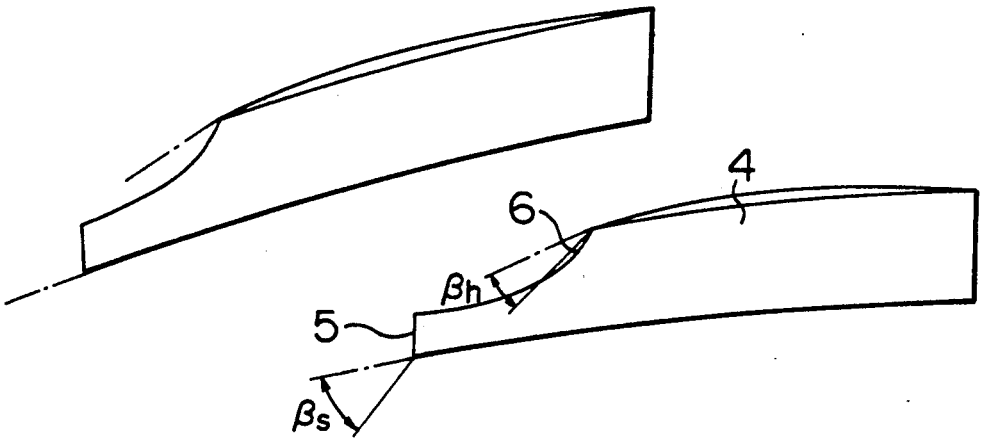
FIG. 5 shows the essential parts of the compressor of FIG. 4 three-dimensionally.

Another embodiment of the present invention will be described with reference to FIGS. 4 and 5. FIG. 4 shows the impeller 1 and the diffuser stator blades 4 as seen when looking in the direction of an axis of a shaft of the impeller 1 and FIG. 5 shows the stator blades in an enlarged fashion. In this embodiment, a blade angle $\beta s$ of the leading edge of the stator blade located on the side of the front shroud is made larger than a blade angle $\beta h$ of the leading edge located on the side of the main shroud. In this way, the minimum cross-sectional area of the diffuser can be increased, the upper limit of the flow rate can thus be further raised, although the configuration of the stator blade becomes complicated.

Figure 6:
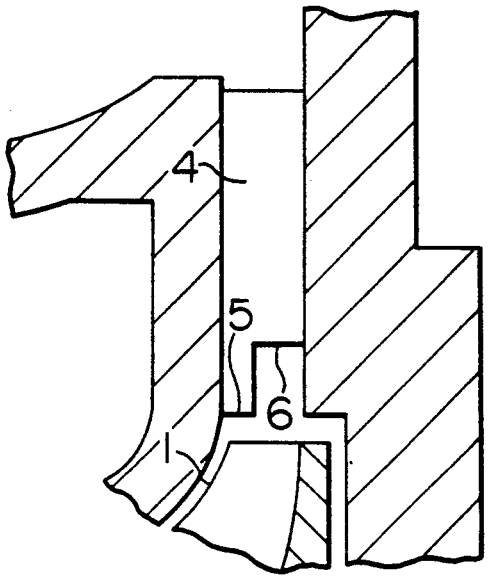
FIGS. 6 and 7 are vertical cross-sectional views of the essential parts of another embodiments of the present invention.
Figure 7:
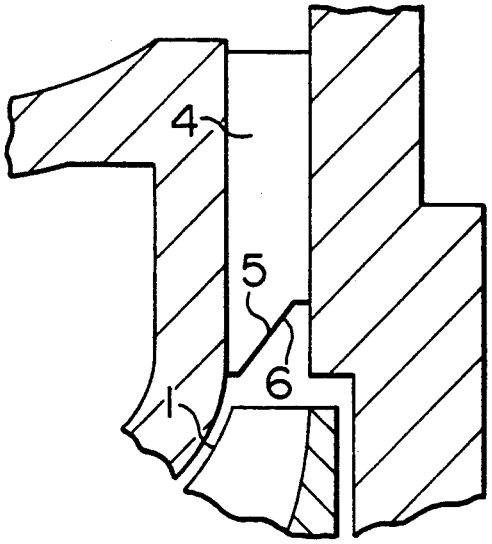

FIGS. 6 and 7 respectively show another embodiments of the present invention. In the stator blade shown in FIG. 6, the leading edge thereof is formed in a step-like fashion so as to be simplified. In the stator blade shown in FIG. 7, the leading edge is straight, which is a simplified form of the configuration shown in FIG. 1. The upper limit of the flow rate can be raised in these embodiments also as in the case of the embodiment shown in FIGS. 4 and 5 by constructing the leading edge of the stator blade such that the angles thereof are distributed in the manner shown in FIGS. 4 and 5.

Figure 8:
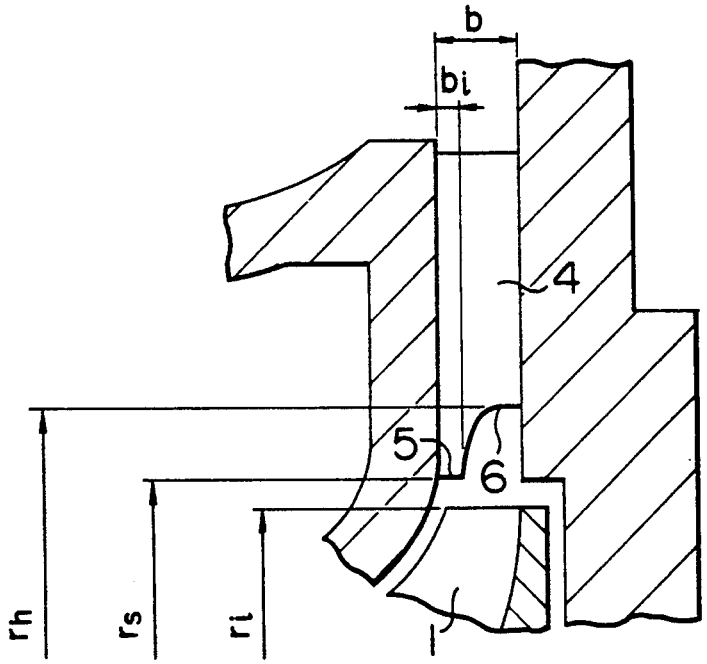
FIG. 8 explains the relation of dimensions.

FIG. 8 shows the relations of the various portions of the leading edge of the blade which assure the most effective operation of the compressor. An effective operation of the compressor is assured when a relation expressed by $1<r_s/r_i<1.1<r_h/r_i$ establishes between a radius $r_i$ of the impeller, a radius $r_s$ of the leading edge portion 5 located on the side of the front shroud, and a radius $r_h$ of the leading edge portion 6 located on the main shroud and a relation expressed by $0.1<b_i/b<0.6$ establishes between an average height $b_i$ of the leading edge portion 5 located on the front shroud and a height b of the stator blade.

FIGS. 9 to 14 show another embodiments of the high-speed centrifugal compressor with auxiliary blades provided near the leading edge portions of the stator blades.

In these compressors, each of auxiliary blades 11 is disposed such that it crosses a circle whose center is the rotary shaft of the impeller 1 and which passes the front edges of the stator blades 4 and such that it does not intersect a perpendicular drawn from the front edge of a stator blade 4*a* among the adjacent stator blades 4*a* and 4*b* the stator blade 4*a* whose radius of curvature is located on the side of the center to the other stator blade 4*b*.

Figure 9:
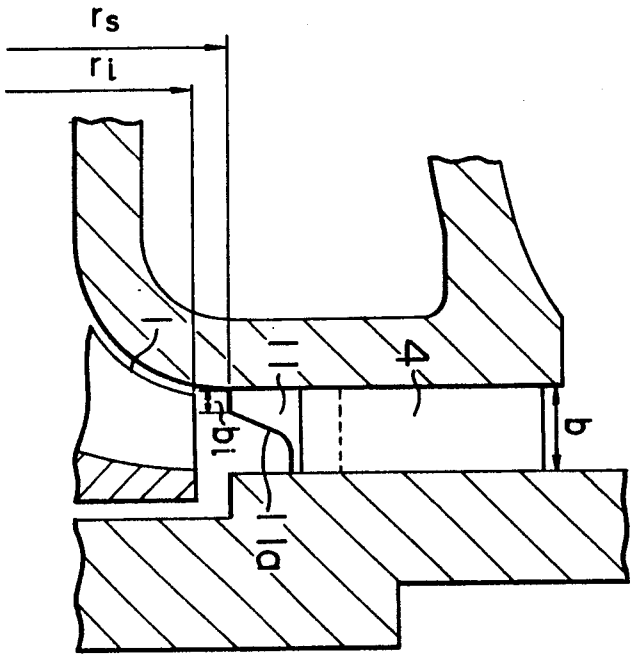
FIG. 9 is a vertical cross-sectional view of another embodiment of the high-speed centrifugal compressor in which an auxiliary blade is provided in each diffuser.

A leading edge 11*a* of the auxiliary blade 11 shown in FIG. 9 is formed such that a portion thereof located on the side of the front shroud is extended toward the impeller 1 than that located on the side of the main shroud, as shown in FIG. 9. The portion of the leading edge 11*a* located closest to the impeller has a height $b_i$.

Figure 11:
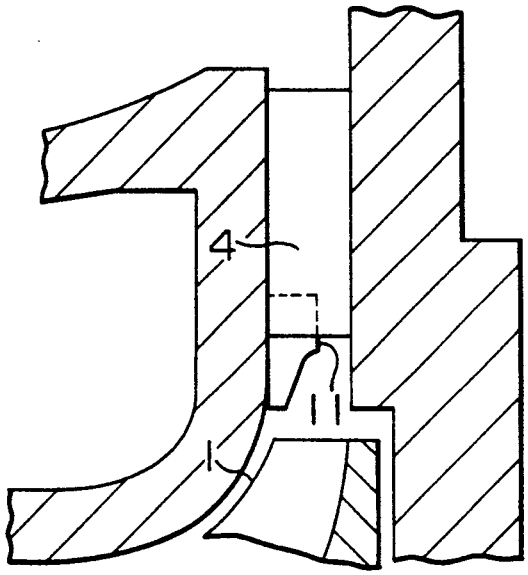
FIG. 11 is a vertical cross-sectional view of a modification of the auxiliary blade.
Figure 12:
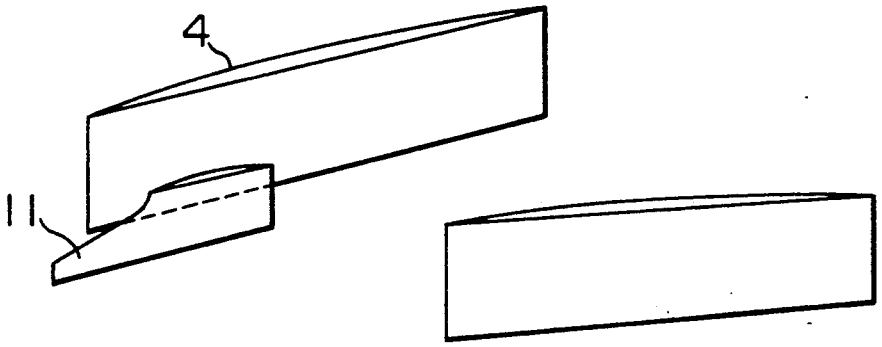
FIG. 12 shows the essential parts of FIG. 11 three-dimensionally.

FIGS. 11 and 12 show a modification of the auxiliary blade shown in FIG. 9. The speed of flow of the fluid along a portion of the auxiliary blade located on the side of the main shroud is fast and that portion does not thus contribute to enlargement of the operation range much. An auxiliary blade shown in FIG. 11 therefore has a small height as compared with that shown in FIG. 9.

Figure 13:
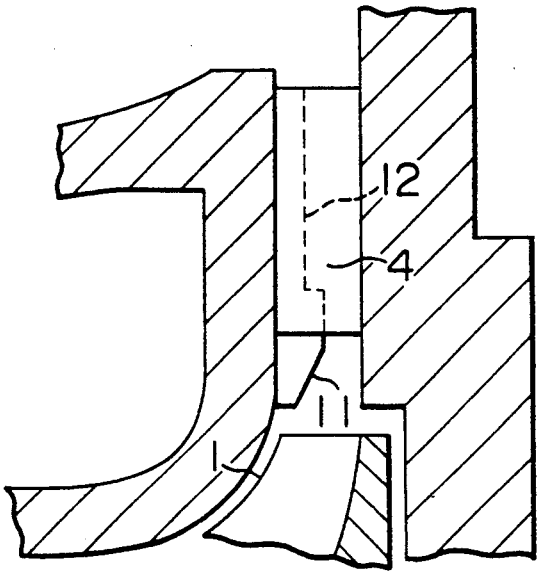
FIG. 13 is a vertical cross-sectional view of a modification of the auxiliary blade.
Figure 14:
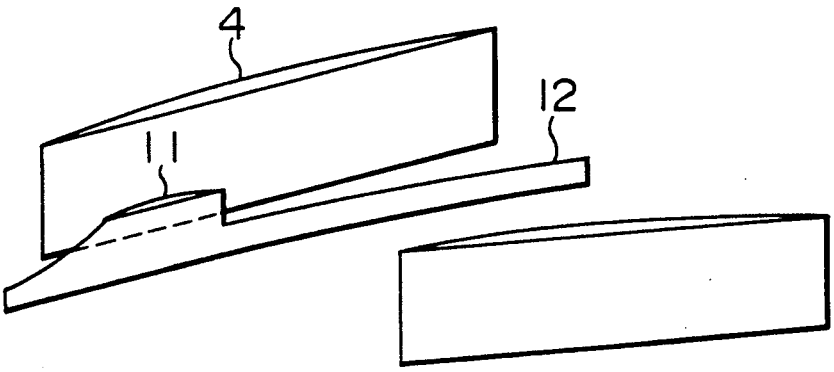
FIG. 14 shows the essential parts of FIG. 13 three-dimensionally.

FIGS. 13 and 14 show another modification of the auxiliary blade shown in FIG. 9. The height of the auxiliary blade shown in FIG. 13 is low. The auxiliary blade has a partitioning member 12 which extends from the downstream side of the auxiliary blade shown in FIGS. 11 and 12 until it reaches a circle which passes through the trailing edges of the stator blades 4.

FIGS. 15 to 23 show embodiments of the high-speed centrifugal compressor with auxiliary blades and intermediate blades respectively provided near the leading edges and the trailing edges of the stator blades.

Figure 10:
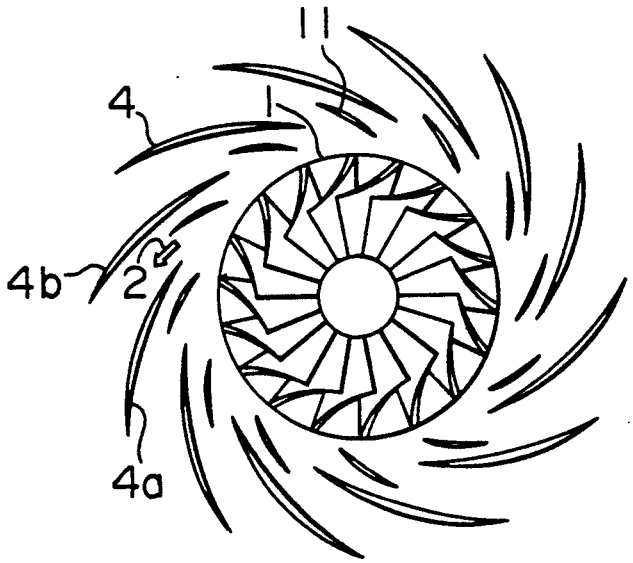
FIG. 10 is a plan view of FIG. 9.
Figure 15:
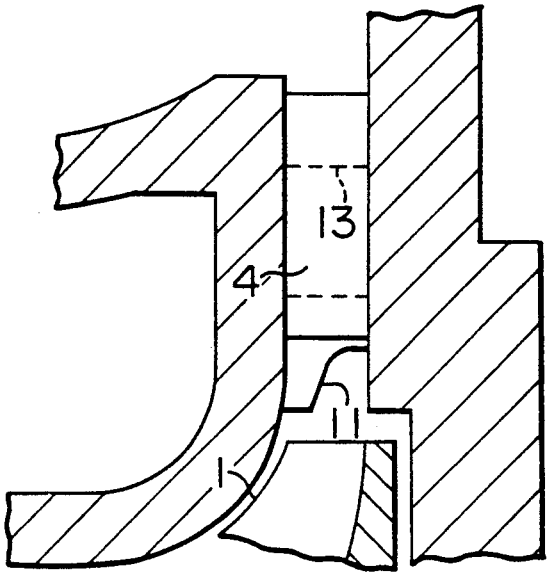
FIG. 15 is a vertical cross-sectional view of another embodiment of the high-speed centrifugal compressor in which an auxiliary blade and an intermediate blade are disposed in each diffuser.
Figure 16:
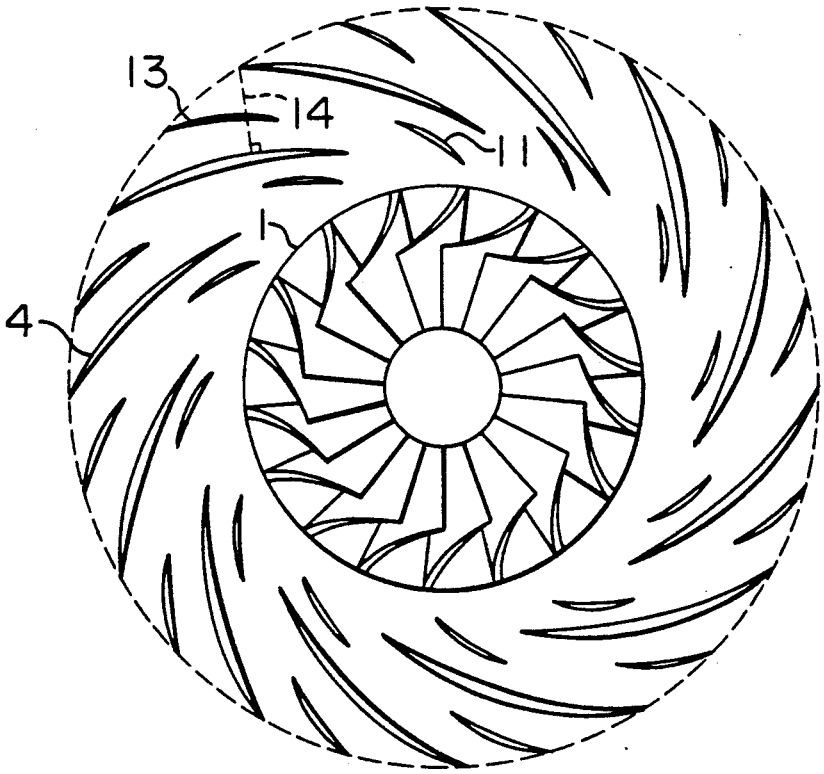
FIG. 16 is a plan view of FIG. 15.

FIGS. 15 and 16 show a compressor in which an intermediate blade 13, having the same height as that of the stator blade, is disposed near the rear side of each of the stator blades 4 in the diffuser shown in FIG. 10 in which the auxiliary blade is disposed. The intermediate blade 13 is disposed such that it passes through the midpoint of a perpendicular 14 drawn from an outer peripheral edge of the stator blade 4 to the surface of the adjacent stator blade and such that the outer peripheral edge thereof reaches a circle which passes through the outer peripheral edges of the stator blades. The length of the portion of the intermediate blade 13 located inside of the midpoint of the perpendicular 14 is 20% or less of the overall length of the intermediate blade.

The entirety of the intermediate blade is located inside of the circle which passes through the outer peripheral edges of the stator blades when it is virtually rotated around the shaft of the impeller. Although it is desirable that the auxiliary blade located near the leading edge of the stator blade has a thickness as small as possible, a certain thickness is necessary in terms of the strength thereof. Hence, the stator blades are provided in number which ensures a sufficient cross-sectional area of the flow passage. However, this increases the space between the adjacent stator blades near the outer periphery thereof and thereby reduces the performance of the compressor. In this embodiment, however, since the intermediate blade is disposed near the outer periphery of the stator blade such that it passes through the midpoint of the perpendicular drawn from the outer peripheral edge of the stator blade to the surface of the adjacent stator blade, the space between the adjacent stator blades is substantially reduced to an appropriate value in the vicinity of the outer peripheral edges thereof, and reduction in the performance can thus be prevented.

Figure 17:
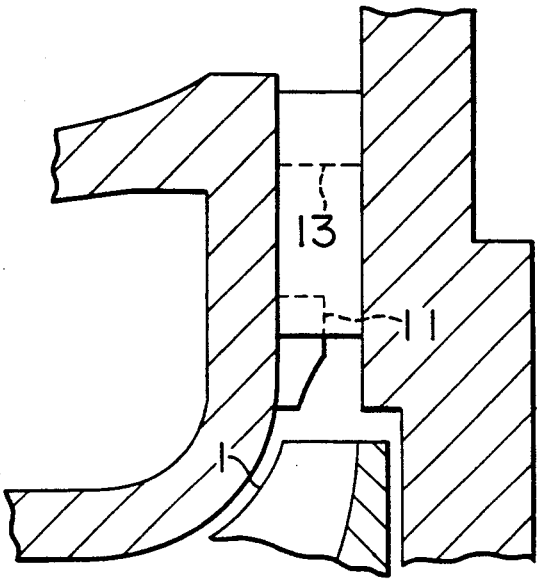
FIG. 17 is a vertical cross-sectional view of a modification of the auxiliary blade of FIG. 15.
Figure 18:
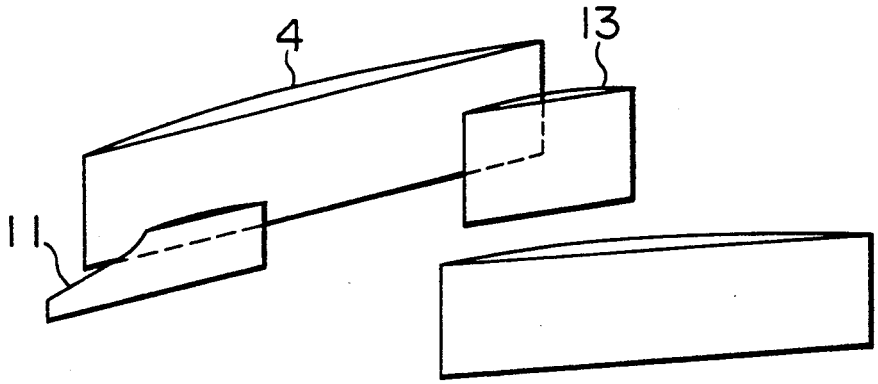
FIG. 18 shows the essential parts of FIG. 17 three-dimensionally.
Figure 21:
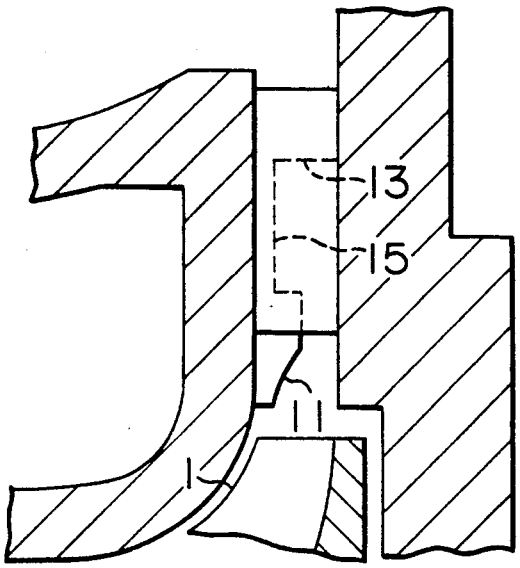
FIG. 21 is a vertical cross-sectional view of another embodiment of the high-speed centrifugal compressor in which the auxiliary blade and the intermediate blade are connected by a partitioning plate in the diffuser.
Figure 22:
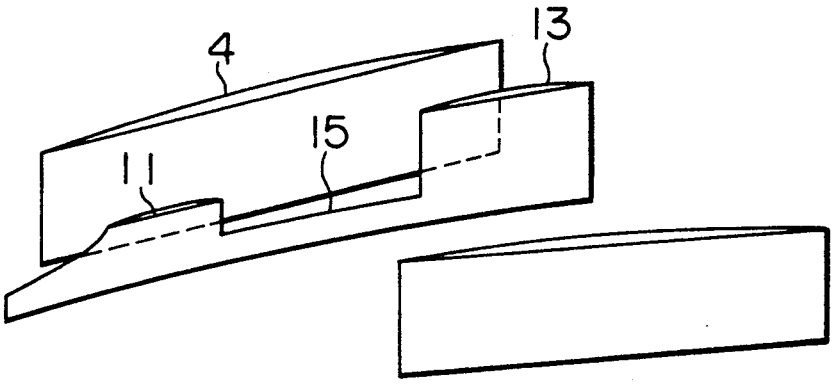
FIG. 22 shows the essential parts of FIG. 21 three-dimensionally.

FIGS. 17 and 18 show a compressor in which an intermediate blade 13, having the same height as that of the stator blade, is disposed near the trailing edge of the stator blade 4 in the diffuser shown in FIG. 11 in which the auxiliary blade is disposed. FIGS. 21 and 22 show a compressor in which the portion of the intermediate blade 13 located on the side of the front shroud and the portion of the auxiliary blade 11 located on the side of the front shroud shown in FIG. 17 is connected by a partitioning member 15 having a sufficiently small height as compared with that of the auxiliary blade.

Figure 19:
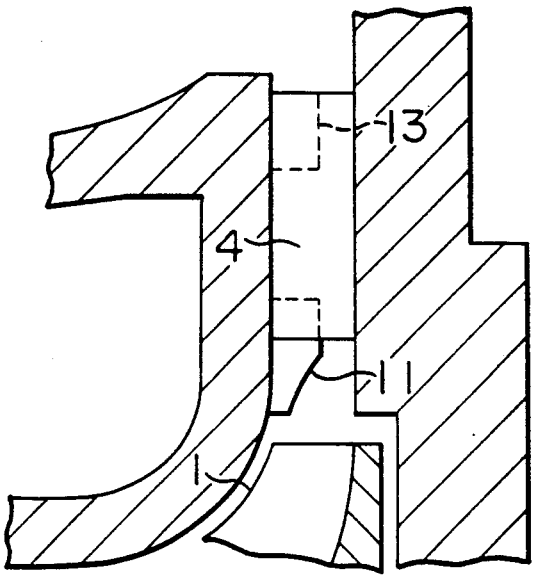
FIG. 19 is a vertical cross-sectional view of a modification of the intermediate blade of FIG. 17.
Figure 20:
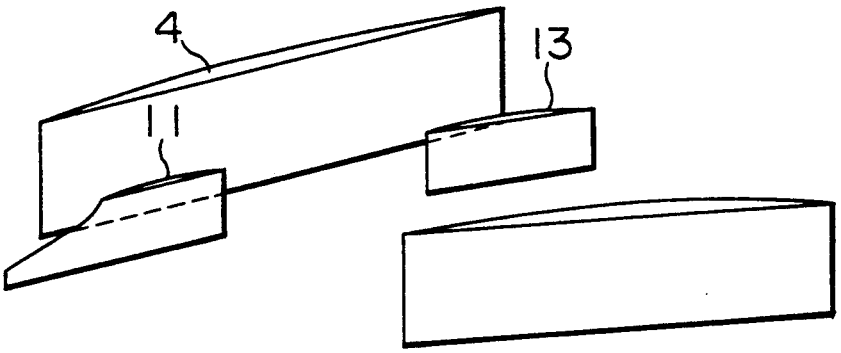
FIG. 20 shows the essential parts of FIG. 17 three-dimensionally.
Figure 23:
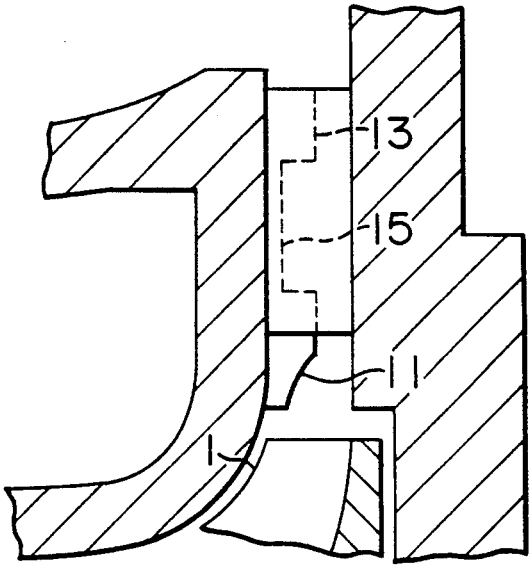
FIG. 23 is a vertical cross-sectional view of another embodiment of the high-speed centrifugal compressor in which the auxiliary blade and an intermediate blade, both of which have a height smaller than that of the stator blade, are connected by the partitioning plate in the diffuser.
Figure 24:
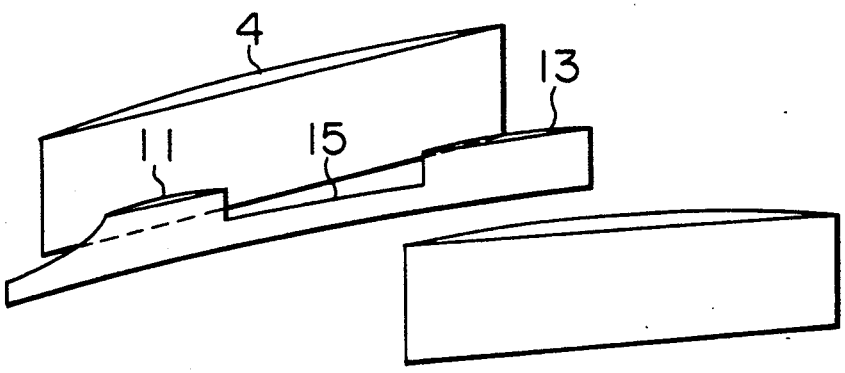
FIG. 24 shows the essential parts of FIG. 23 three-dimensionally.

FIGS. 19 and 20 show a compressor in which an intermediate blade 13, having the same height as that of the auxiliary blade, is disposed near the trailing edge of the stator blade 4 in the diffuser shown in FIG. 11 in which the auxiliary blade is disposed. FIGS. 23 and 24 show a compressor in which the portion of intermediate blade 13 located on the side of the front shroud and the portion of the auxiliary blade 11 located on the side of the front shroud shown in FIG. 19 is connected by a partitioning member 15 having a sufficiently small height as compared with that of the auxiliary blade.

What is claimed is:

1. A centrifugal compressor with diffusers provided therein so as to convert kinetic energy of a fluid discharged from an impeller to pressure energy due to a plurality of stator blades disposed near an outer periphery of said impeller, wherein a portion of each of said stator blades located on a side of a front shroud is disposed closer to said impeller than a portion thereof located on a side of a main shroud and a first portion of a leading edge of each of said stator blades located on the side of the front shroud is perpendicular to the front shroud, a second portion of the leading edge of each of said stator blades located on a side of the main shroud is perpendicular to the main shroud, and a third portion of the leading edge connecting said first portion to said second portion is inclined from the second portion thereof located on the side of said main shroud to the first portion thereof located on the side of said front shroud.

2. A centrifugal compressor according to claim 1, wherein an inlet angle of a portion of the leading edge of said stator blade located on the side of said front shroud is larger than an inlet angle of a portion of the leading edge located on the side of said main shroud in each of said diffusers.

3. A centrifugal compressor with diffusers provided therein so as to convert kinetic energy of a fluid discharged from an impeller to pressure energy due to a stator blade disposed near an outer periphery of said impeller, wherein an auxiliary blade, having a chord length less than that of the stator blade and a height equal to or less than that of the stator blade, is provided near an inner periphery of the stator blade in each of said diffusers, only one blade surface of said auxiliary blade being disposed in opposed relation to the stator blade, a portion of a leading edge of said auxiliary blade located on a side of a front shroud being perpendicular to the front shroud and a remaining portion of the leading edge of the auxiliary blade being inclined to an outer radius of the auxiliary blade.

4. A centrifugal compressor according to claim 3, wherein a partitioning plate having a height less than that of said auxiliary blade and extending along said stator blade is connected to a downstream side of said auxiliary blade in each of said diffusers.

5. A centrifugal compressor comprising:

diffusers for converting kinetic energy of a fluid discharged from an impeller to pressure energy due to a stator blade disposed near an outer periphery of said impeller, wherein an auxiliary blade, having a chord length less than that of the stator blade and a height equal to or less than that of the stator blade, is provided near an inner periphery of the stator blade in each of said diffusers, only one blade surface of said auxiliary blade being disposed in opposed relation to the stator blade, a portion of a leading edge of said auxiliary blade located on a side of a front shroud being perpendicular to the front shroud and a remaining portion of the leading edge of said auxiliary blade being inclined to an outer radius of said auxiliary blade, and an intermediate blade, having a chord length smaller than that of said stator blade and a height equal to or smaller than that of said stator blade, is provided adjacent to the stator blade near the outer periphery thereof.

6. A centrifugal compressor according to claim 5, wherein said auxiliary blade and said intermediate blade are connected by a partitioning plate which has a height less than that of both of said auxiliary and intermediate blades and which extends along the stator blade.

* * * * *

UNITED STATES PATENT AND TRADEMARK OFFICE

CERTIFICATE OF CORRECTION

PATENT NO. : 5,178,516
DATED : January 12, 1993
INVENTOR(S) : K. Nakagawa, et. al.

It is certified that error appears in the above-indentified patent and that said Letters Patent is hereby corrected as shown below:

On the Title page, item [21], Appl. No. 591,651, should be -- 591,965--.

Signed and Sealed this

First Day of February, 1994

*Attest:*

*Attesting Officer*

BRUCE LEHMAN

*Commissioner of Patents and Trademarks*